US007827970B2

(12) United States Patent
Smith et al.

(10) Patent No.: US 7,827,970 B2
(45) Date of Patent: Nov. 9, 2010

(54) VAPOR SEPARATOR

(75) Inventors: Roger N. Smith, Lapeer, MI (US); David L. Speirs, Cass City, MI (US); Scott F. Stedry, Freeland, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 250 days.

(21) Appl. No.: 12/052,812

(22) Filed: Mar. 21, 2008

(65) Prior Publication Data

US 2009/0071448 A1 Mar. 19, 2009

Related U.S. Application Data

(60) Provisional application No. 60/896,175, filed on Mar. 21, 2007.

(51) Int. Cl.
*F02M 37/04* (2006.01)
*F02M 15/00* (2006.01)

(52) U.S. Cl. ..... 123/509; 123/540

(58) Field of Classification Search ..... 123/516, 123/540, 541, 573, 514, 41.31, 518, 509; 210/188, 151, 416.4
See application file for complete search history.

(56) References Cited

U.S. PATENT DOCUMENTS 3,910,302 A * 10/1975 Sudhir ..... 137/43
5,036,822 A 8/1991 Kojima
5,103,793 A 4/1992 Riese et al.
5,137,002 A 8/1992 Mahoney et al.
5,146,901 A 9/1992 Jones
5,203,306 A * 4/1993 Billingsley et al. ..... 123/518
5,389,245 A 2/1995 Jaeger et al.
5,579,740 A 12/1996 Cotton et al.
5,647,331 A 7/1997 Swanson
5,797,378 A 8/1998 Kato
5,819,711 A 10/1998 Motose
5,855,197 A 1/1999 Kato
5,996,561 A 12/1999 Watanabe
6,012,434 A 1/2000 Hartke et al.
6,076,509 A 6/2000 Kyuma
6,125,827 A 10/2000 Wada et al.
6,231,318 B1 5/2001 Cotton et al.
6,257,208 B1 7/2001 Harvey
6,408,835 B1 6/2002 Katayama et al.
6,422,207 B1 7/2002 Kolb et al.
6,447,351 B1 9/2002 Nanami
6,502,559 B2 1/2003 Katayama et al.
6,553,974 B1 4/2003 Wickman et al.
6,557,533 B2 5/2003 Katayama et al.
6,581,579 B1 6/2003 Knight et al.
6,607,361 B1 8/2003 Kotter et al.
6,634,341 B2 10/2003 Crary et al.
6,655,366 B2 12/2003 Sakai (Continued)

*Primary Examiner*—Mahmoud Gimie
(74) *Attorney, Agent, or Firm*—Reising Ethington P.C.

(57) ABSTRACT

A vapor separator includes a fuel pump, and a container at least partially defining a fuel reservoir to hold fuel and a pump chamber to hold the fuel pump. A closure is carried by the container to close the fuel reservoir and at least partially defines a vapor chamber above a level of fuel in the fuel reservoir and in fluid communication with the pump chamber. A vapor vent device is carried by the closure to allow fuel vapor to vent out of the vapor separator from the vapor chamber and prevent liquid fuel from flowing therethrough when the vapor separator is declined.

35 Claims, 15 Drawing Sheets

U.S. PATENT DOCUMENTS

| | | | | |
|---|---|---|---|---|
| 6,662,786 | B2 | 12/2003 | Watanabe | |
| 6,679,229 | B2 | 1/2004 | Wada et al. | |
| 6,718,953 | B1 | 4/2004 | Torgerud | |
| 6,857,419 | B1 | 2/2005 | Harvey et al. | |
| 6,923,165 | B1 | 8/2005 | Draves et al. | |
| 7,013,878 | B1 | 3/2006 | Cotton et al. | |
| 7,168,414 | B2 | 1/2007 | Harvey | |
| 7,431,021 | B1 * | 10/2008 | Achor | 123/520 |
| 2002/0174894 | A1 * | 11/2002 | Kolb et al. | 137/202 |
| 2007/0101974 | A1 * | 5/2007 | Achor | 123/516 |

* cited by examiner

VAPOR SEPARATOR

CROSS-REFERENCE TO RELATED APPLICATION

The instant application claims priority to and benefit of U.S. Provisional Application Ser. No. 60/896,175 filed Mar. 21, 2007, the entire contents of which is expressly incorporated herein by reference.

FIELD OF THE INVENTION

The present invention relates generally to fuel systems for combustion engines, and more particularly to a vapor separator.

BACKGROUND OF THE INVENTION

Vapor separators are typically used to separate fuel vapor from liquid fuel injected into a marine outboard motor. A conventional vapor separator is usually connected with inlet and outlet fuel lines between a fuel tank and a fuel-injected engine of the outboard motor. The vapor separator typically includes a water separating filter carried in an enclosed reservoir in which a quantity of liquid fuel is maintained with a float valve. A fuel pump receives liquid fuel from the reservoir and pressurizes it for downstream delivery through fittings and hoses to a fuel rail in fluid communication with the fuel injectors. A fuel pressure regulator is typically carried by a downstream end of the fuel rail and returns excess fuel not injected into the engine from the fuel rail to the vapor separator through fittings and hoses.

The returned fuel is often heated, having been routed near the engine through the fuel rail, and having also been heated by the fuel pump prior to delivery to the fuel rail. Accordingly, fuel vapor is generated when the heated return fuel enters the reservoir. The vapor separator typically includes a vent valve to vent the fuel vapor in the reservoir outside of the vapor separator to the engine for combustion therein.

Conventional vapor separators may include one or more of the following drawbacks. First, excessive space may be required to package a conventional vapor separator and its inlet and outlet hoses under cowling of an outboard motor. Second, a conventional vapor separator may leak when tilted past horizontal. Third, the fuel pump may generate fuel vapor, which may be delivered downstream to the engine. Fourth, return fuel may be heated, thereby contributing to fuel vaporization. Fifth, fuel pump motor wires may define a leak path for fuel or the fuel pump may extend out of the reservoir.

SUMMARY OF THE INVENTION

According one exemplary form of the invention, a vapor separator includes a fuel pump, and a container at least partially defining a fuel reservoir to hold fuel and a pump chamber to hold the fuel pump. The vapor separator also includes a closure carried by the container to close the fuel reservoir and at least partially define a vapor chamber above a level of fuel in the fuel reservoir and in fluid communication with the pump chamber. The vapor separator further includes a vapor vent device carried by the closure to allow fuel vapor to vent out of the vapor separator from the vapor chamber and prevent liquid fuel from flowing therethrough when the vapor separator is declined. According to preferred aspects of this form, the vapor vent device may be a rollover type of vent valve or a diaphragm type of vent valve.

According to another exemplary form of the invention, a vapor separator includes a fuel pump including an outlet, and a container at least partially defining a pump chamber in which the fuel pump is disposed and a fuel reservoir to hold fuel. The container includes injector return passages and a common injector return conduit in fluid communication with the return passages and the fuel reservoir, and further includes injector supply passages and a common injector supply conduit in fluid communication with the supply passages and the outlet of the fuel pump.

According to a further exemplary form of the invention, a vapor separator includes a fuel pump, and a container at least partially defining a pump chamber in which the fuel pump is disposed and a fuel reservoir to hold fuel, and a fuel pressure regulator carried by the container.

According to an additional exemplary form of the invention, a vapor separator includes a fuel pump, and a container at least partially defining a pump chamber in which the fuel pump is disposed and a fuel reservoir to hold fuel. The vapor separator further includes a non-coiled heat exchanger tube extending through the fuel reservoir.

According to still another exemplary form of the invention, a vapor separator includes a fuel pump including an inlet end, and an inlet port and a vapor purge port at the inlet end, and a container at least partially defining a pump chamber in which the fuel pump is disposed and a fuel reservoir to hold fuel. The vapor separator also includes a seal carried by the inlet end of the fuel pump. The seal includes an outer surface to engage a portion of the container, a recess to engage the inlet end of the fuel pump, and a divider including a projection in contact with the inlet end of the fuel pump to sealingly separate the inlet port from the vapor purge port. The seal also includes an inlet aperture in fluid communication with the inlet port, a vapor purge pocket in fluid communication with the vapor purge port, and a vapor purge aperture in fluid communication between the vapor purge pocket and the pump chamber.

At least some of the objects, features and advantages that may be achieved by at least certain embodiments of the invention include providing a vapor separator that includes an integrated fuel rail, a fuel pressure regulator, and/or a fuel filter; is able to be packaged under cowling of an outboard motor; does not leak liquid fuel when tilted past horizontal; vents fuel vapor generated by a fuel pump; cools fuel returned from fuel injectors; attaches directly to injector housings; is resistant to corrosion and is relatively light weight; provides reliable venting and internal pressure control; provides an improved water passage and coolant flow arrangement; resist plugging of the coolant flow passage; provides improved hot fuel handling and vapor handling; is of relatively simple design, economical manufacture and assembly, rugged, durable, reliable, and in service has a long useful life.

Of course, other objects, features and advantages will be apparent in view of this disclosure to those skilled in the art. Various other vapor separators embodying the invention may achieve more or less than the noted objects, features or advantages.

BRIEF DESCRIPTION OF THE DRAWINGS

These and other objects, features and advantages of the present invention will be apparent from the following detailed description of preferred embodiments and best mode, appended claims, and accompanying drawings in which:

DETAILED DESCRIPTION OF PREFERRED EMBODIMENTS

Figure 4:
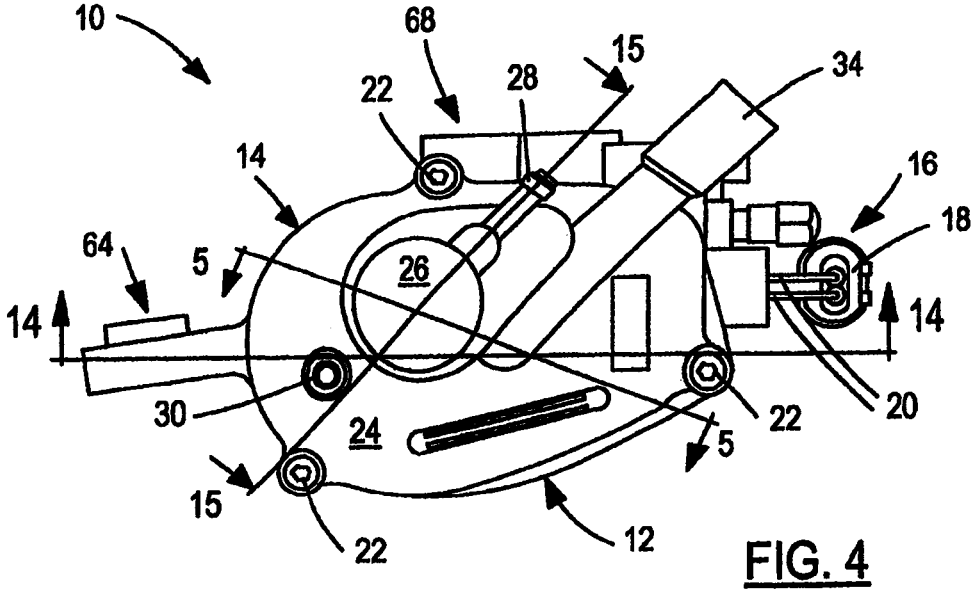
FIG. 4 is a top view of the vapor separator of FIG. 1, taken from arrow 4 thereof.

Referring in more detail to the drawings, FIGS. 1 through 4 illustrate a vapor separator 10 to separate fuel vapor from liquid fuel, which may be pressurized by the vapor separator 10 for delivery to an internal combustion engine, such as for an outboard motor or any other engine-powered product. The vapor separator 10 may generally include a container assembly 12 that may receive, hold, cool, filter, and/or pressurize fuel, and a closure assembly 14 sealingly carried by the container assembly 12 that may receive, meter, and/or vent fuel vapor out of the vapor separator 10. The vapor separator 10 may also include an electrical wiring assembly 16 including an electrical connector 18 and wires 20 connected to the connector 18. As best shown in FIG. 4, the closure assembly 14 may be mounted to the container assembly 12 in any manner, such as using fasteners 22, or snap-fit, clips, or the like.

Referring to FIGS. 1 through 4, the closure assembly 14 includes a closure 24, which may have several integral features. For example, the closure 24 may include a vapor vent housing 26 and vent outlet fitting 28 in fluid communication with the interior of the vapor vent housing 26. Also, the closure 24 may include an integral coolant fitting 30 such as a coolant inlet fitting. Further the closure 24 may include a fuel inlet conduit, which may include a longitudinal fuel inlet fitting 32 and a transverse fuel inlet conduit 34.

Figure 5:
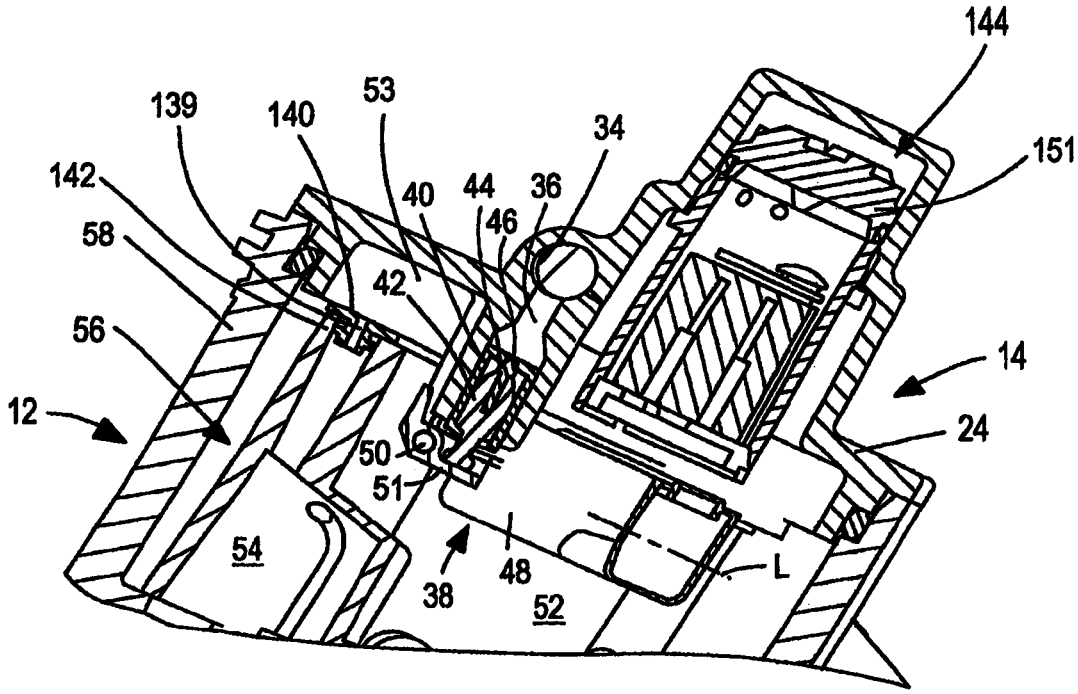
FIG. 5 is an enlarged, partial, cross-sectional view of a portion of the vapor separator shown in FIG. 4, taken along line 5-5 thereof.

Referring to FIG. 5, the fuel inlet conduit may further include an inlet valve boss and passage 36 carried by the closure 24 and in fluid communication with the transverse fuel inlet conduit 34. The inlet valve boss and passage 36 may be in fluid communication with a float valve assembly 38 of the closure assembly 14 that may be carried by the closure 24.

The float valve assembly 38 may include a valve seat 40 carried in the inlet valve boss and passage 36, and an inlet valve 42 that may be carried in the valve seat 40. The inlet valve 42 may carry a seal 44 that cooperates with an aperture 46 in the valve seat 40. The float valve assembly 38 may also include a float 48 that floats in liquid fuel in the vapor separator 10, a pivot pin 50 carried by a portion of the closure 24, a pivot arm 51 pivotably mounted to the closure 24 via the pivot pin 50 and carrying the float 48. Float valve assemblies are well known in the art, and any suitable type and configuration may be used.

As a level of fuel L in the vapor separator 10 falls below a given level, the float 48 lowers, allowing the inlet valve 42 to lower and permit fuel to flow through the fuel inlet conduit, between the valve 42 and valve seat 40. Grooves or other fuel paths (not shown) may be suitably provided between the inlet valve 42 and valve seat 40 to facilitate fuel flow when the valve 42 opens.

From the inlet valve 42, incoming fuel flows into the interior of the vapor separator. The interior may include a fuel reservoir 52 and a pump chamber 54, which may be at least partially defined by a fuel pump cover 56 of the container assembly 12. The closure 24 may also at least partially define a vapor chamber 53 above the level of fuel L in the fuel reservoir 52. In other words, the vapor chamber 53 may be defined anywhere between the level of fuel L in the reservoir 52 and any portion(s) of the closure 24. The level of fuel L may vary, but typically may be established by the float valve assembly 38.

Figures 1, 2, 3:
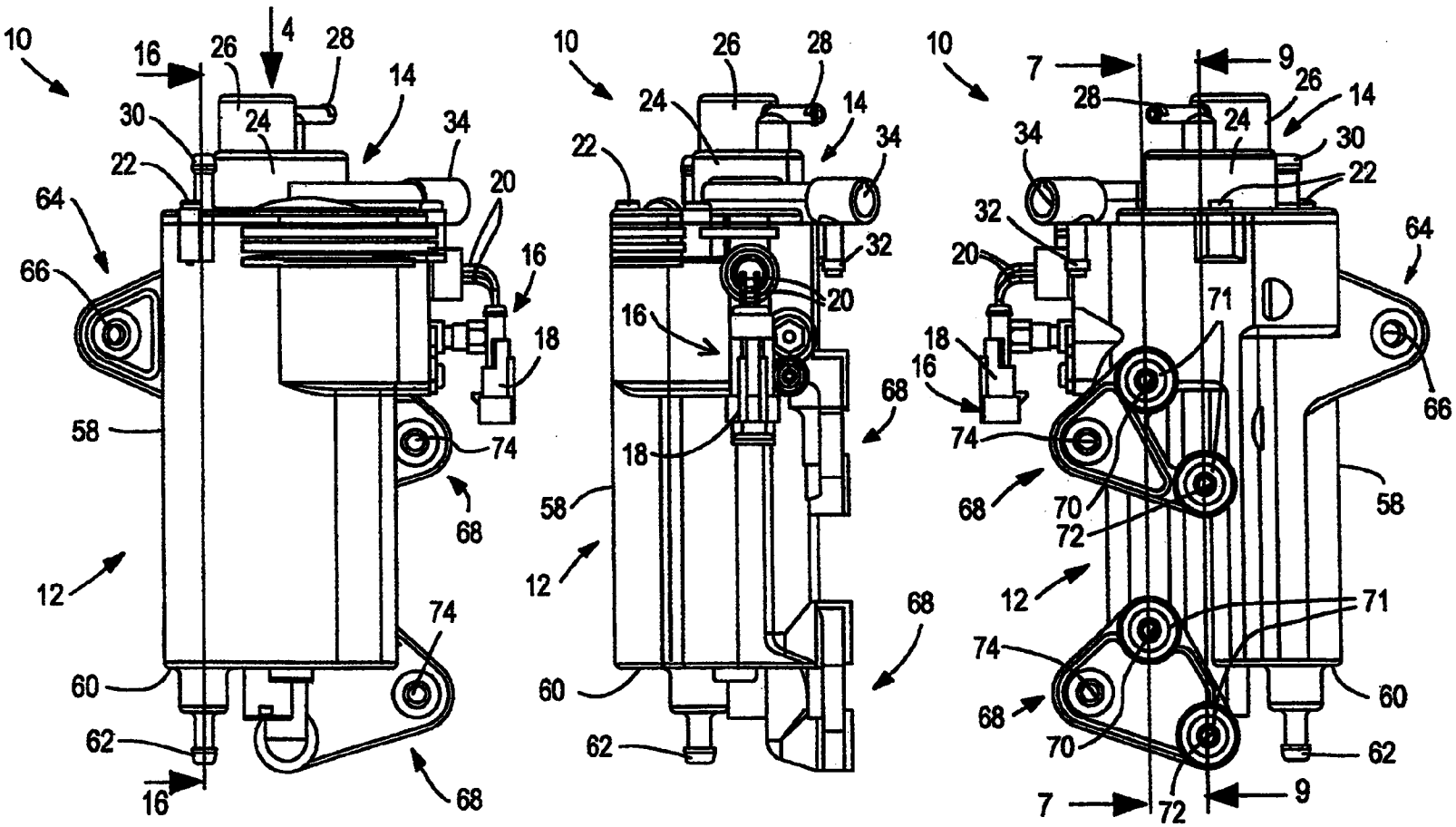
FIG. 1 is a rear elevational view of a first exemplary form of a vapor separator for an internal combustion engine.
FIG. 2 is a side elevational view of the vapor separator of FIG. 1.
FIG. 3 is a front elevational view of the vapor separator of FIG. 1.

Referring to FIGS. 1 through 3, the container assembly 12 also includes a container 58, which may have several integral components. For example, a bottom wall 60 of the container 58 may include an integrally extending coolant fitting 62 such as an outlet coolant fitting. In another example, a first mounting boss 64 may integrally extend outwardly from the container 58 and may include a first mounting aperture 66 to accept a fastener (not shown). Also, a fuel rail may be integrated with the container 58 and may include injector mounting bosses 68. The fuel rail may also include injector return passages 70, injector supply passages 72, and/or mounting apertures 74 extending through the mounting bosses 68.

Figure 6:
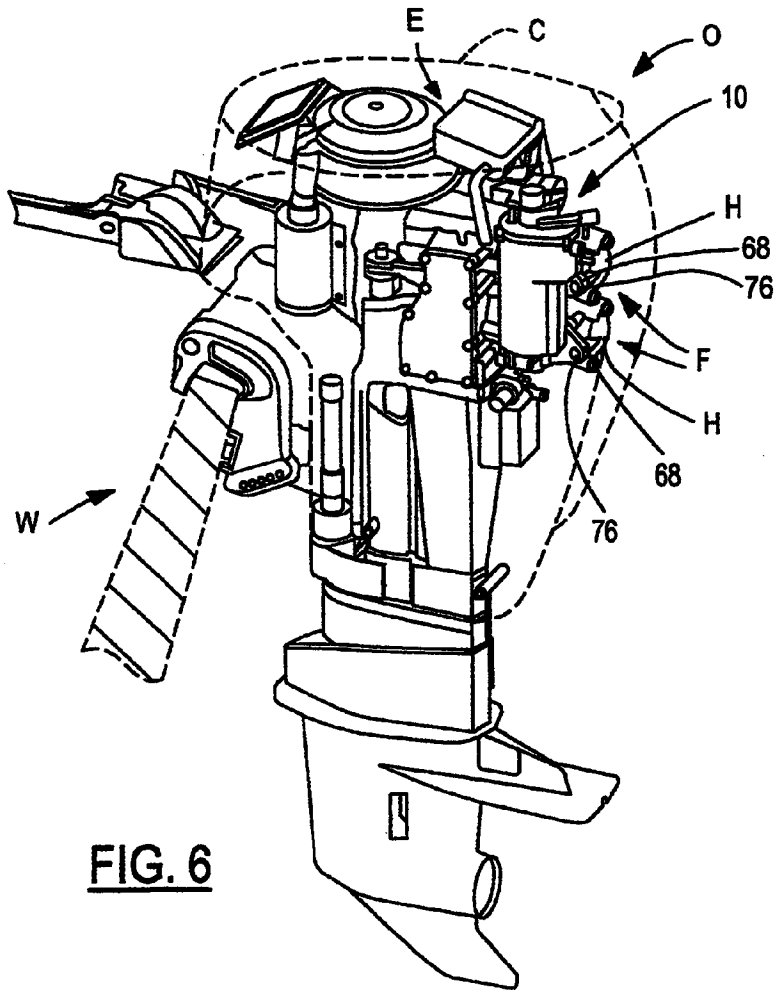
FIG. 6 is a perspective view of a portion of an exemplary watercraft including an exemplary outboard motor including the vapor separator of FIG. 1.

Referring to FIG. 6, the mounting bosses 64, 68 may be used to mount the vapor separator 10 to an engine E, or another portion of an outboard motor O of a watercraft W. More particularly, the injector mounting bosses 68 may be mounted to corresponding housings H of fuel injectors F of the engine E, such as with fasteners 76.

Figure 7:
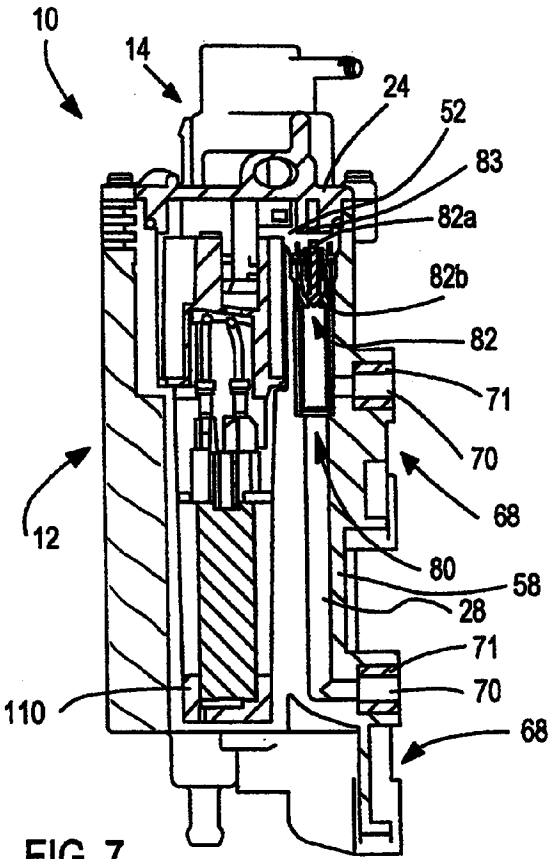
FIG. 7 is a cross-sectional view of the vapor separator shown in FIG. 3, taken along line 7-7 thereof.

Referring also to FIG. 7, the integral fuel rail may also include seals 71 disposed in the return passages 70 to sealingly engage corresponding fittings (not shown) of the injector housings H. The integral fuel rail may further include a common return conduit 78 in the container 58 in communication with the return passages 70. The return conduit 78 may extend in a generally longitudinal direction from a lower one of the return passages 70, past an upper one of the return passages 70, and may terminate in an open end beneath the closure 24.

The container assembly 12 may further include a fuel filter 80 disposed in the return conduit 78 to filter fuel returned from the fuel injectors, and a pressure regulator 82 to permit fuel in excess of that used by the engine to return to the fuel reservoir 52. The filter 80 may be any type of pressure side fuel filter and may not be a water separating type of filter. The pressure regulator 82 may be any type of fuel pressure regulator, and may include a spring biased valve 82*a* carried in a valve seat 82*b*. The closure 24 may include a pocket 83 that may accept and guide a portion of the valve 82*a*. Excess fuel returned from the injectors flows through the filter 80 and pressure regulator 82, and into the interior of the vapor separator 10. The pocket 83 may be open along one side thereof that does not face the float assembly 38 so as to direct incoming fuel away from the float assembly 38. In this way, incoming fuel will not spray and, thus, interfere with, the fuel metering performed by the float assembly 38. Liquid fuel may flow into and collect in the container assembly 12, whereas fuel vapor may flow into and collect in the fuel reservoir 52 above the level of liquid fuel.

Figure 8:
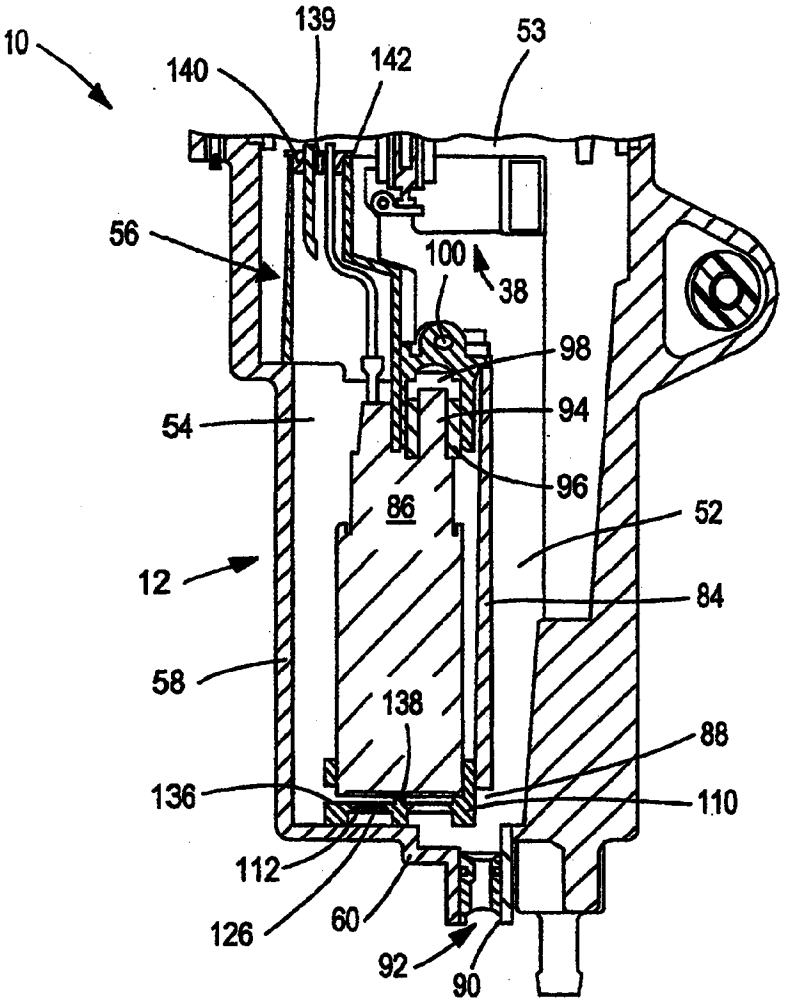
FIG. 8 is an enlarged cross-sectional view of a portion of the vapor separator of FIG. 1.

Referring to FIGS. 7 and 8, the interior of the container assembly 12 may be separated into the fuel reservoir 52 and the pump chamber 54 by an internal wall 84 of the container 58 and by the fuel pump cover 56 sitting atop the internal wall 84. The container assembly 12 may also include a fuel pump assembly 86 disposed in the pump chamber 54. The fuel pump assembly 86 may be supported by the container assembly 12, including the pump cover 56.

The fuel from the fuel tank and/or the injectors collects in the fuel reservoir 52 and is drawn therefrom by the fuel pump assembly 86. A gap is defined between the bottom of the container 60 and a portion of the internal wall 84 to define a fluid passage 88 between the fuel reservoir 52 and the pump chamber 54. A manufacturing boss and passage 90 may be formed in the container 58 to facilitate creation of the passage 88, and may be sealed with a plug 92. As will be described in further detail below, fuel is drawn through the passage 88 and into the fuel pump assembly 86. The fuel may be pressurized by and conveyed through the fuel pump assembly 86, and out a fuel outlet 94 of the assembly 86 that may be sealed to the pump cover 56 by a seal 96 such as a cylindrical polymeric seal as shown.

Figure 9:
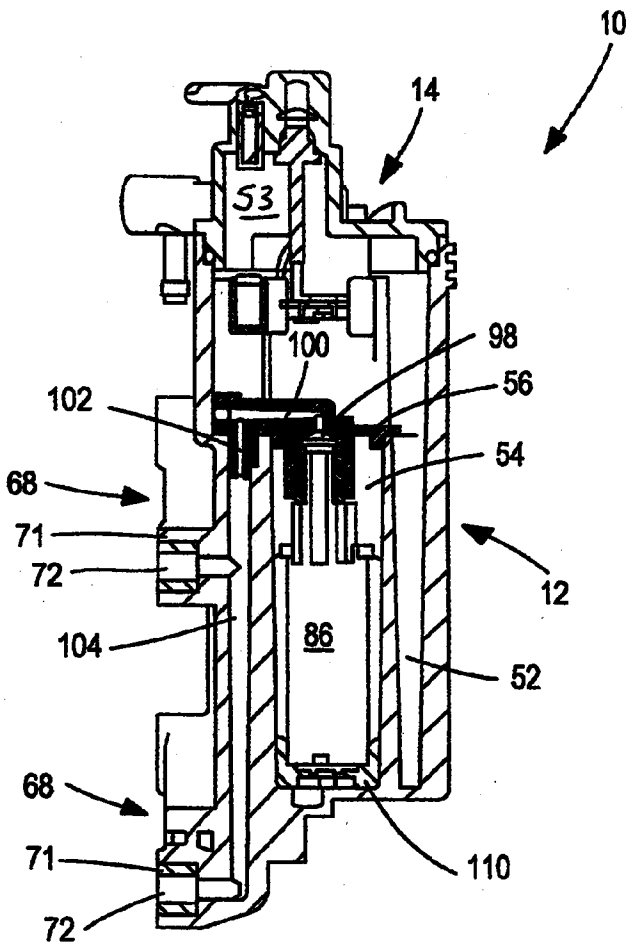
FIG. 9 is a cross-sectional view of the vapor separator of FIG. 3, taken along line 9-9 thereof.
Figure 10:
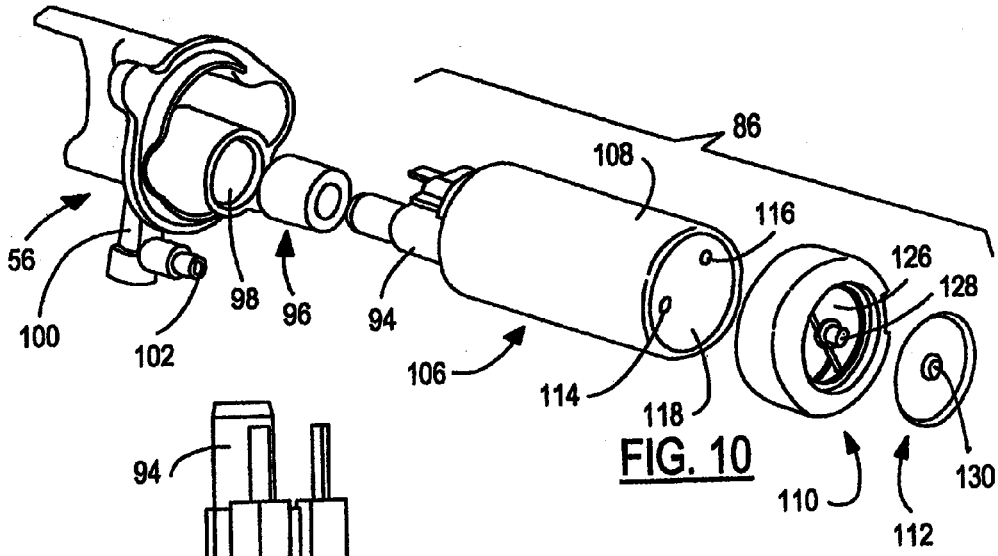
FIG. 10 is an exploded perspective view of a portion of the vapor separator of FIG. 1, including a fuel pump assembly.
Figure 11:
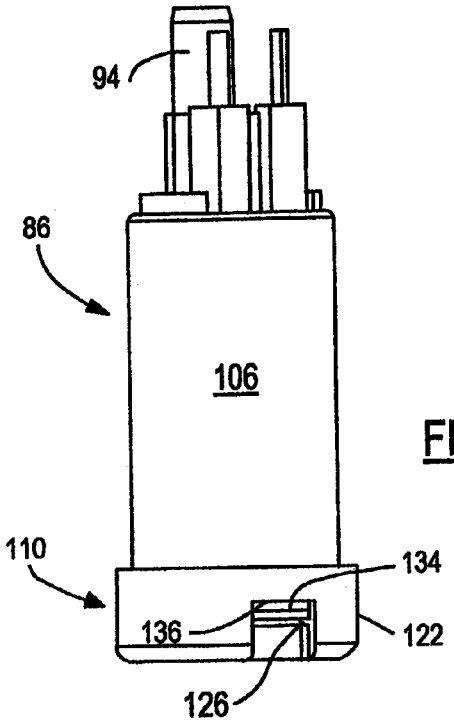
FIG. 11 is an elevational view of an exemplary form of the fuel pump assembly shown in FIG. 10.
Figure 13:
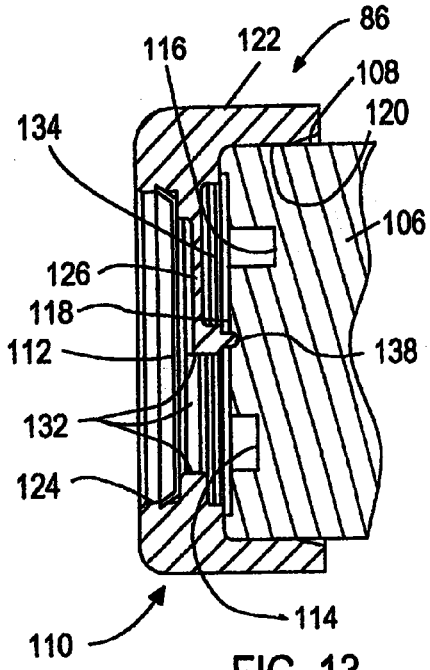
FIG. 13 is an enlarged, cross-sectional view of the fuel pump assembly shown in FIG. 12, taken along line 13-13 thereof.
Figure 12:
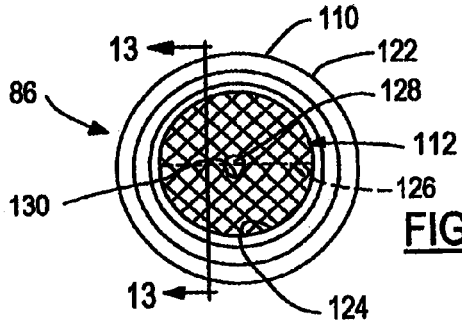
FIG. 12 is a bottom view of the fuel pump assembly shown in FIG. 11.

Referring to FIGS. 9 and 10, pressurized fuel flows into and through the pump cover 56. The pressurized fuel flows into a bore 98 of the pump cover 56, and through a fuel outlet conduit, which may include a transverse branch and passage 100 in communication with the bore 98, and an outlet fitting and passage 102 in communication with the transverse branch 100. As shown in FIG. 9, the outlet fitting and passage 102 may be inserted into a common injector supply conduit 104 of the integrally formed fuel rail of the container assembly 12. Accordingly, pressurized fuel flows through the supply conduit 104 and out of the vapor separator 10 and to the fuel injectors through the injector supply passages 72. The injector supply passages 72 may include seals 71 disposed therein for sealing engagement with corresponding portions of the injector housings.

Referring now to FIGS. 10-13, the fuel pump assembly 86 may include a motorized fuel pump 106 having an inlet end 108, a partitioned seal 110 carried by the inlet end 108, and a suction fuel filter 112 carried by the seal 110. The fuel pump 106 may be any type of fuel pump, such as a vane pump, impeller pump, gerotor pump, or the like. The inlet end 108 of the pump 106 may include an inlet port 114 and a vapor purge port 116 in a bottom 118.

The seal 110 may include a first recess 120 to engage the inlet end 108 of the pump 106, an outer surface 122 to engage corresponding portions of the container 58, a second recess 124 to partially carry the filter 112, and a divider 126 extending partially across the second recess 124 to separate the inlet port 114 from the vapor purge port 116. The divider 126 may also carry an axially extending locating post 128 that may extend through a corresponding locating hole 130 in the filter 112. The seal 110 may also include an inlet aperture 132 between a portion of the divider 126 and an opposed portion of the second recess 124. Accordingly, the inlet port 114 is in direct downstream fluid communication with the filter 126. The seal 110 may further include a vapor purge pocket 134 in fluid communication with the vapor purge port 116 of the pump 106, and a vapor purge aperture 136 through the side of the seal 110 and in fluid communication with the vapor purge pocket 134. The divider 126 of the seal 110 may additionally include a divider projection 138 sealed against and across the bottom 118 of the fuel pump 106 to sealingly divide the inlet port 114 and inlet aperture 132 from the purge port 116 and vapor purge pocket 134. Accordingly, the seal 110 facilitates venting of fuel vapor produced by the fuel pump 106 to a location outside of the fuel pump assembly 86.

Figure 14:
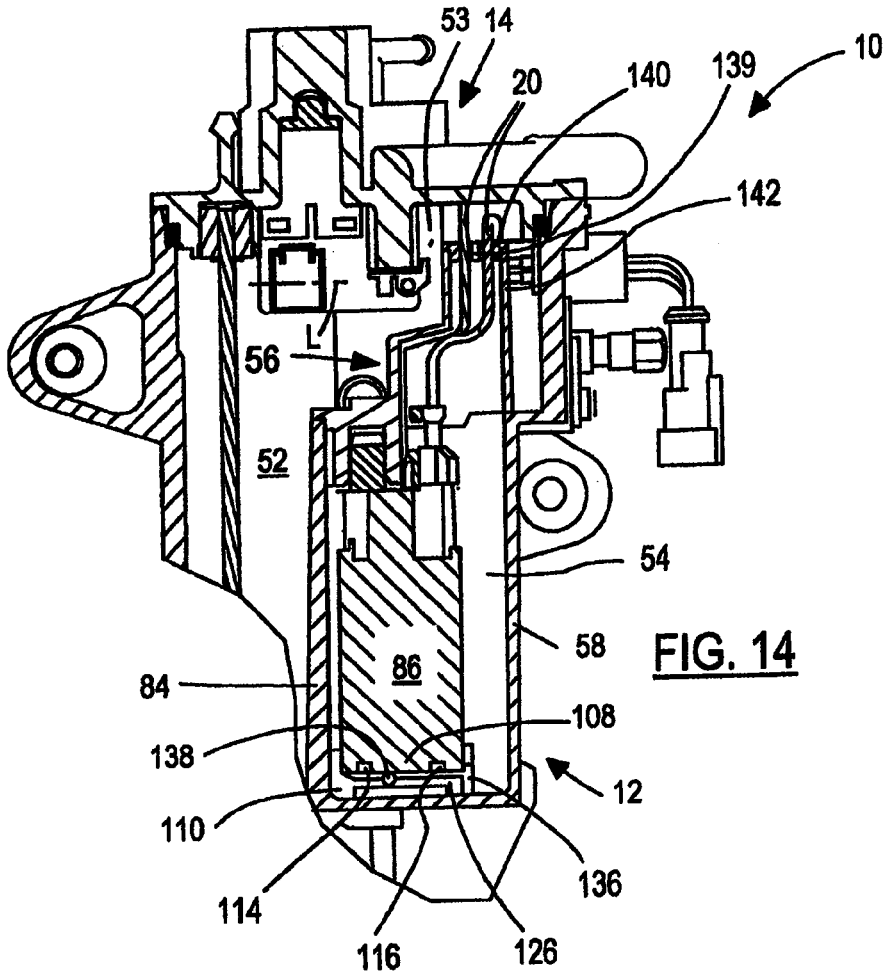
FIG. 14 is a cross-sectional view of the vapor separator shown in FIG. 4, taken along line 14-14 thereof.

As shown in FIGS. 8 and 14, fuel vapor from the pump 86 is vented into the fuel pump chamber 54, separate from the fuel reservoir 52. The fuel vapor may be conducted generally upwardly above the fuel pump assembly 86, and through the fuel pump cover 56 to a location above the level of liquid fuel in the fuel reservoir 52. More particularly, the fuel vapor may flow through one or more vent passages 139 in a wire grommet 140 carried in an open upper end 142 of the pump cover 56. The wire grommet 140 thus may serve to carry and protect the wires 20 and to conduct fuel vapor from the pump chamber 54 to the vapor chamber 53.

Figure 15:
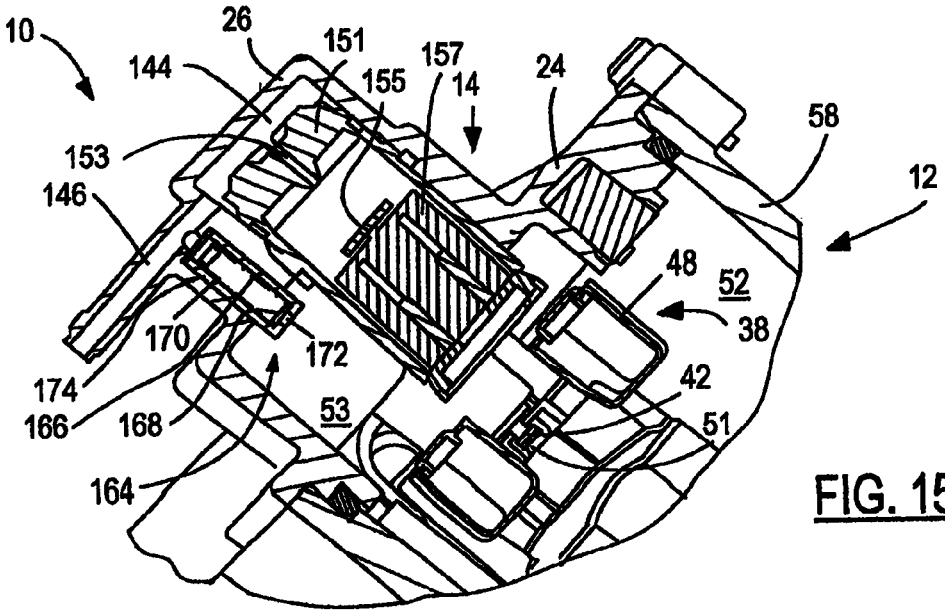
FIG. 15 is a cross-sectional view of the vapor separator shown in FIG. 4, taken along line 15-15 thereof.

Referring to FIGS. 5 and 15, the fuel vapor in the interior of the vapor separator 10 may be vented externally of the vapor separator 10. Fuel vapor may be contained within the vapor separator 10 above a level of fuel, such as in the space between the level of the fuel and the closure 24. The fuel vapor may, ordinarily, be freely vented through a vent valve 144, which may be disposed in the vent valve housing 26 of the closure 24. Fuel vapor may freely flow through the vent valve 144 and out of a vent outlet passage 146, such as through the vent outlet fitting 28. From the vent outlet passage 146, the fuel vapor may vent anywhere, such as to the atmosphere, to an intake manifold of the engine, to the fuel tank, to a carbon canister, or any other suitable location(s).

The vent valve 144 may allow fuel vapor to vent out of the vapor separator from the vapor chamber 53 and prevent liquid fuel from flowing therethrough, such as when the vapor separator 10 is inverted or even merely declined. As used herein, the term declined includes tilted from a generally upright orientation past horizontal. As shown in FIG. 1, the vapor separator 10 is upright, vertical, or at its maximum inclination. However, the vapor separator 10 may become tilted more than 90 degrees from its shown position, at and beyond which angle it would be declined.

In such cases, the vent valve 144 prevents flow of liquid fuel therethrough. The vent valve 144 may include a rollover type of vent valve. For example, one exemplary vent valve of this type is disclosed in U.S. Pat. No. 6,634,341, which is assigned to the assignee hereof and is incorporated herein by reference in its entirety. The vent valve 144 may include a sleeve 151 disposed in the housing 26 and including a vapor outlet 153. The vent valve 144 may also include a valve 155 and a movable body 157 movably carried in the sleeve 151. The valve 155 is configured to close the vapor outlet 153, such as when the body 157 slides within the sleeve 151 toward the vapor outlet 153, for example, when the outboard motor O is declined or tilted past horizontal. Otherwise, fuel vapor flows through one or more passages in the sleeve 151 and out of the vent valve 144 through the outlet 153 and out of the vapor separator 10 through the vent outlet passage 146.

Referring to FIG. 15, in addition to the vent valve 144, the vapor separator 10 may also include a pressure relief valve 164, which may be carried in a relief passage 166 of the closure 24 and may be in fluid communication with the vent outlet passage 146. The pressure relief valve 164 may include a valve head 168 that may be biased by a spring 170 to seal an aperture 172 of a valve seat 174 to prevent fluid from flowing through the relief passage 166 until a predetermined threshold pressure is reached or exceeded within the vapor separator 10. In other words, the pressure relief valve 164 limits the maximum pressure in the vapor separator 10 to prevent damage to the vapor separator 10 and associated components.

Figure 16:
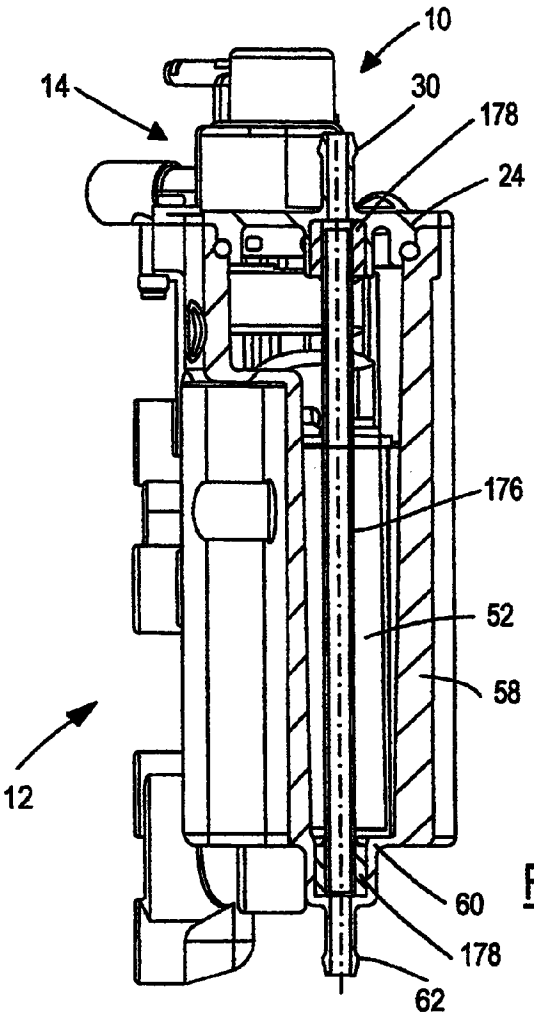
FIG. 16 is a cross-sectional view of the vapor separator of FIG. 1, taken along line 16-16 thereof.

As best shown in FIG. 16, the vapor separator 10 may include a heat exchanger tube 176, which may extend through the fuel reservoir 52 and through which coolant may flow. The heat exchanger tube 176 may include a non-coiled tube, such as a straight tube as shown. Nonetheless, the tube 176 may also or instead include a bent, but non-coiled, tube. In any case, the shape of the tube 176 is such that it provides improved resistance to plugging of particles or objects in the coolant.

The tube 176 may be carried between the closure 24 and the bottom 60 of the container 58. More specifically, the end of the tube 176 may be carried in a pocket of the closure 24 with a seal 178 therebetween, and in fluid communication with the coolant inlet 30. Also, the other end of the tube 176 may be carried in a pocket in the bottom 60 of the container 58 with a seal 178 therebetween and in fluid communication with the coolant outlet 62. The tube 176 may be formed of a material preferably having high thermal conductivity such as a metal, and, more particularly, stainless steel. Relatively cool fluid may be passed through the tube 176, such as water, particularly when the fuel vapor separator 10 is used with a marine engine. Heat from relatively hot fuel in the fuel reservoir 52 may be transferred to the coolant in the tube 176 to cool the fuel.

FIGS. 17 through 26 illustrate another exemplary form of a vapor separator 210. This form is similar in many respects to that shown in FIGS. 1 through 16, which is incorporated by reference into the following description of the vapor separator 210, and vice-versa. Like numerals between the forms generally designate like or corresponding elements throughout the several views of the drawing figures. Additionally, the description of the common subject matter generally may not be repeated here.

Figure 17:
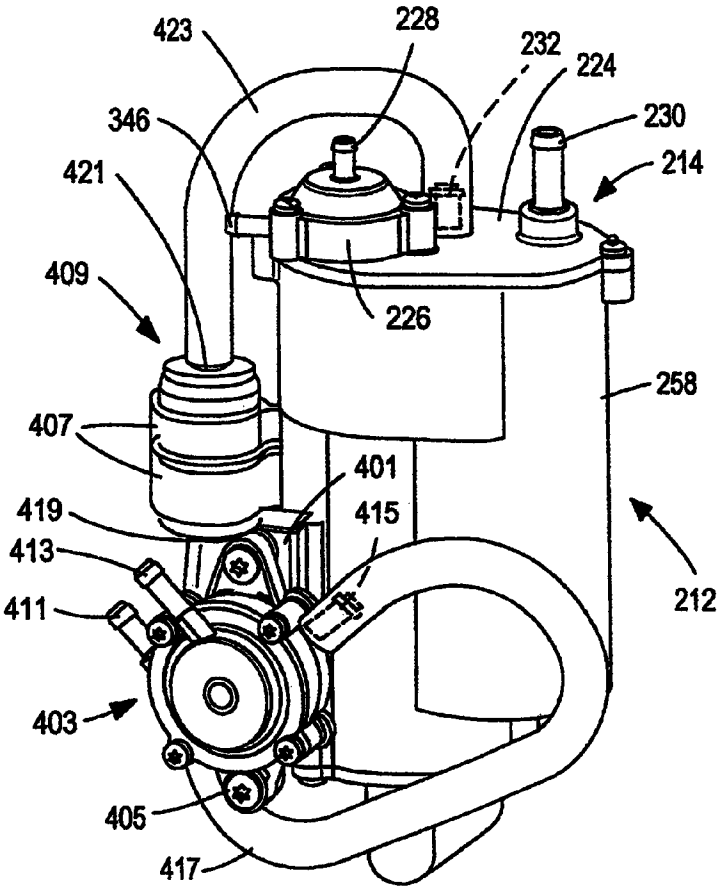
FIG. 17 is a rear perspective view of second exemplary form of a vapor separator for an internal combustion engine.
Figure 18:
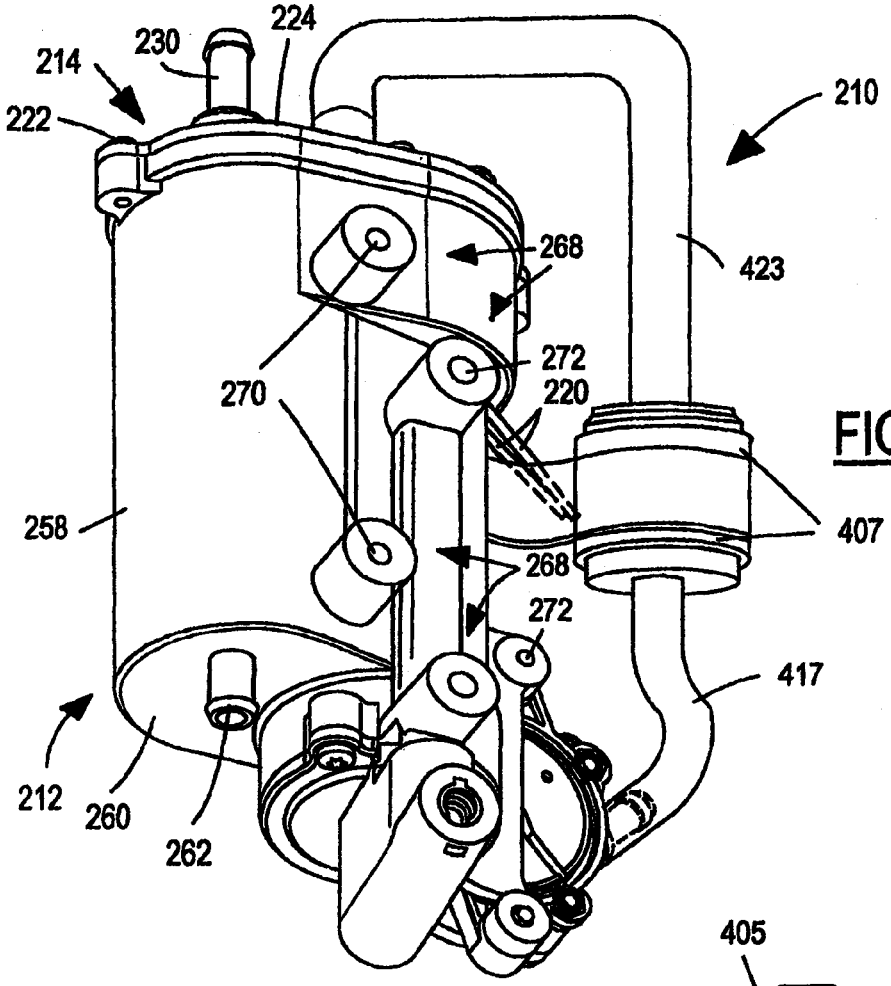
FIG. 18 is a front perspective view of the vapor separator of FIG. 17.
Figure 19:
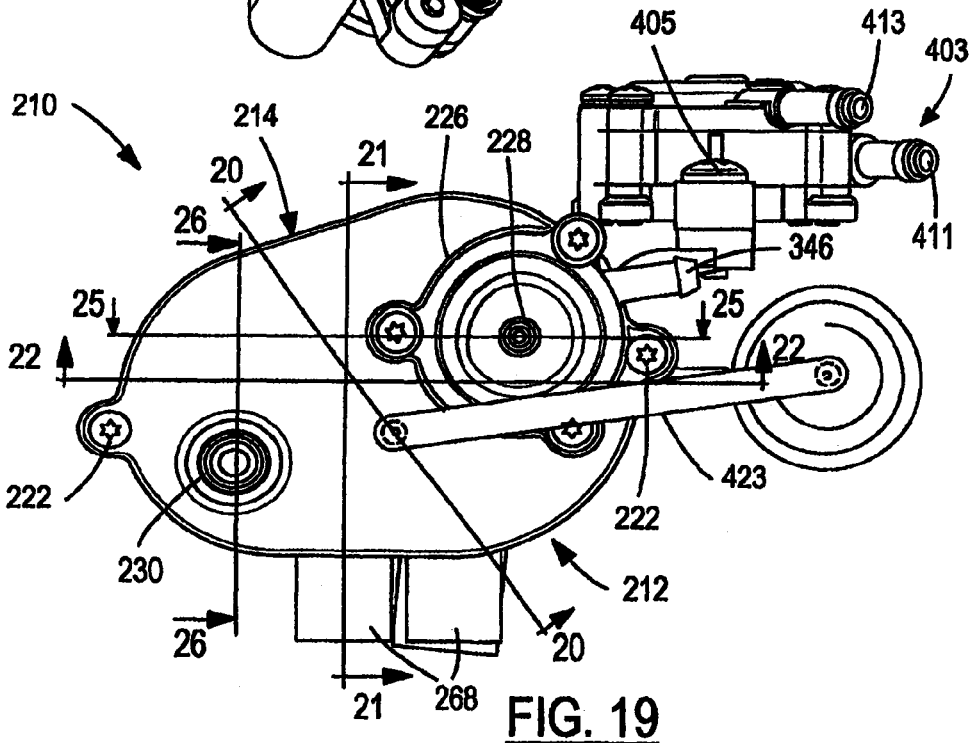
FIG. 19 is a top view of the vapor separator of FIG. 17.

Referring to FIGS. 17 through 19, the vapor separator 210 separates fuel vapor from liquid fuel, which may be pressurized by the vapor separator 210. The vapor separator 210 may generally include a container assembly 212 that may receive, hold, cool, filter, and/or pressurize fuel, and a closure assembly 214 mounted to the container assembly 212 that may receive, meter, and/or vent fuel vapor.

Referring to FIG. 17, the container assembly 212 may include a container 258 to hold fuel and provide structural support for other portions of the vapor separator 210. For example, the container 258 may include a pump mounting boss 401 to which a fuel pump 403 may be mounted such as with fasteners 405, and a filter mounting bracket 407 to which a fuel filter 409 may be mounted. Accordingly, the vapor separator 210 may include the fuel pump 403 and the filter 409.

The fuel pump 403 receives fuel, pressurizes the fuel using vacuum or pressure pulses from an engine (not shown), and delivers the fuel downstream into the vapor separator. The fuel pump 403 may include a fuel inlet 411 to receive fuel from a source such as a fuel tank (not shown), a crankcase pulse inlet 413 to receive pressure pulses from an engine crankcase (not shown), and a fuel outlet 415 to transmit pressurized fuel downstream through a pump outlet conduit 417, such as a flexible hose or tube, to the fuel filter 409. The fuel pump 403 may be of any suitable type, such as a diaphragm type of fuel pump.

The fuel filter 409 receives pressurized fuel, removes particles, and conveys filtered and pressurized fuel downstream to the closure assembly 214 of the vapor separator 210. The fuel filter 409 may include a fuel inlet 419 to receive fuel from the fuel pump 403, and a fuel outlet 421 to transmit filtered and pressurized fuel through a filter outlet conduit 423, such as a flexible hose or tube, to the closure assembly 14. The fuel filter 409 may be of any suitable type, such as one having a cylindrical, corrugated fiber filter element.

Referring to FIGS. 17 through 19, the closure assembly 214 includes a cover 224, which may be attached to the container 258 using fasteners 222, snap-fit, clips, or the like, and may have several integral features. For example, the cover 224 may include a vapor vent housing 226 to carry a vapor vent cover and vacuum fitting 228. Also, the cover 224 may include an integral coolant fitting 230 such as a coolant inlet fitting. Further the cover 224 may include a fuel inlet fitting 232 connected to the filter outlet conduit 423.

Figure 20:
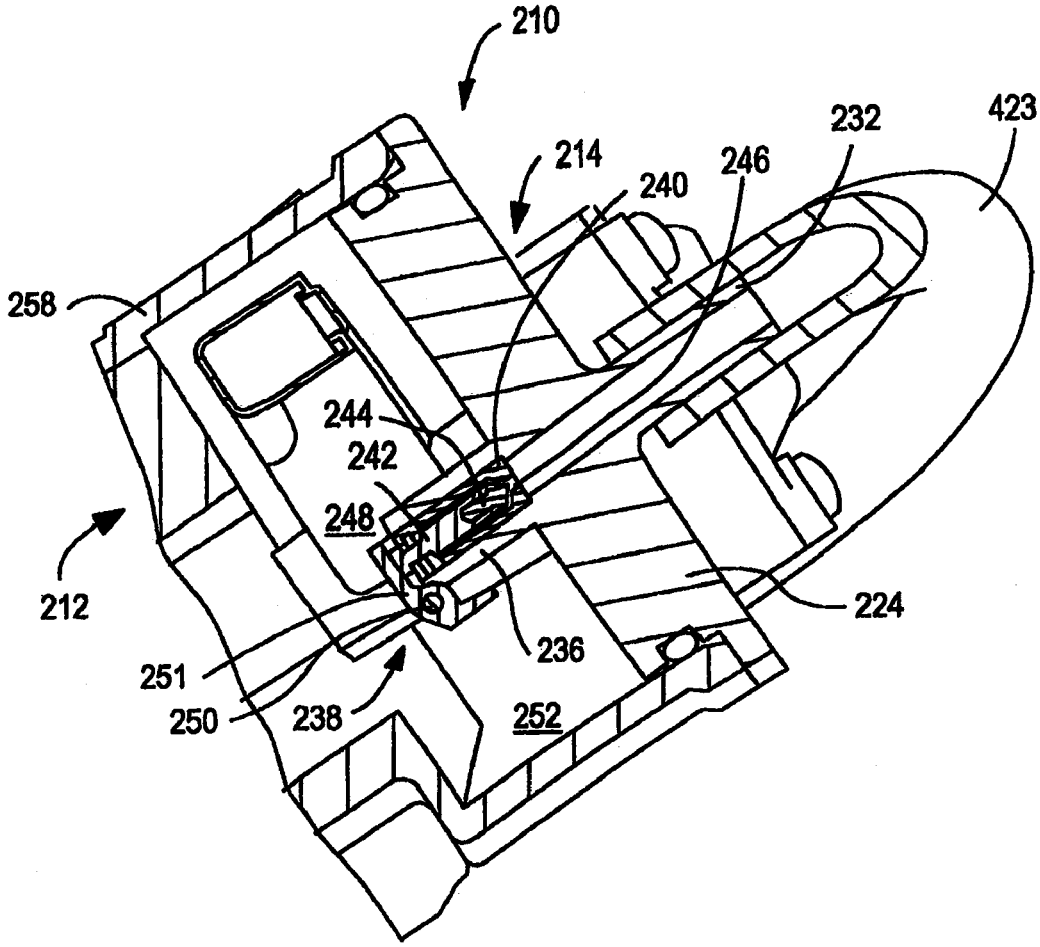
FIG. 20 is a cross-sectional view of the vapor separator shown in FIG. 19, taken along line 20-20 thereof.

Referring to FIG. 20, the closure assembly 214 may include a fuel inlet conduit, which may include the inlet fitting 232 and an inlet valve boss and passage 236 in fluid communication with the fuel inlet fitting 232. The inlet conduit may be in fluid communication with a float valve assembly 238 of the closure assembly 214, which may be carried by the cover 224.

The float valve assembly 238 may include a valve seat 240 carried in the inlet valve boss and passage 236, and an inlet valve 242 that may be carried in the valve seat 240. The inlet valve 242 may carry a seal 244 that cooperates with an aperture 246 in the valve seat 242. The float valve assembly 238 may also include a float 248 that floats in liquid fuel in the vapor separator 210, a pivot pin 250 carried by a portion of the cover 224, and a float arm 251 pivotably mounted to the cover 224 by the pivot pin 250 and carrying the float 248. Float valve assemblies are well known in the art, and any suitable type and configuration may be used.

Figure 22:
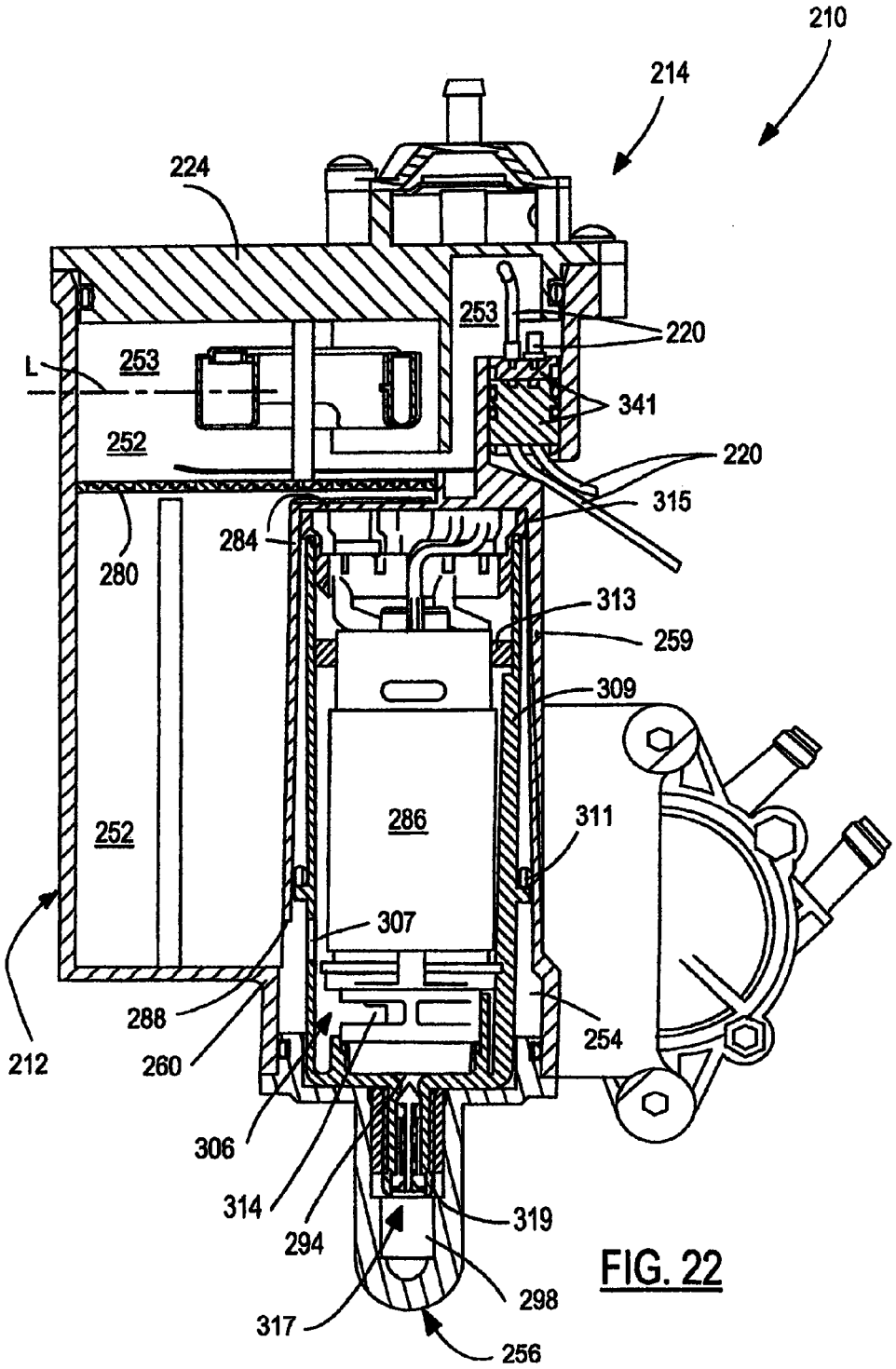
FIG. 22 is a cross-sectional view of the vapor separator shown in FIG. 19, taken along line 22-22 thereof.
Figure 23:
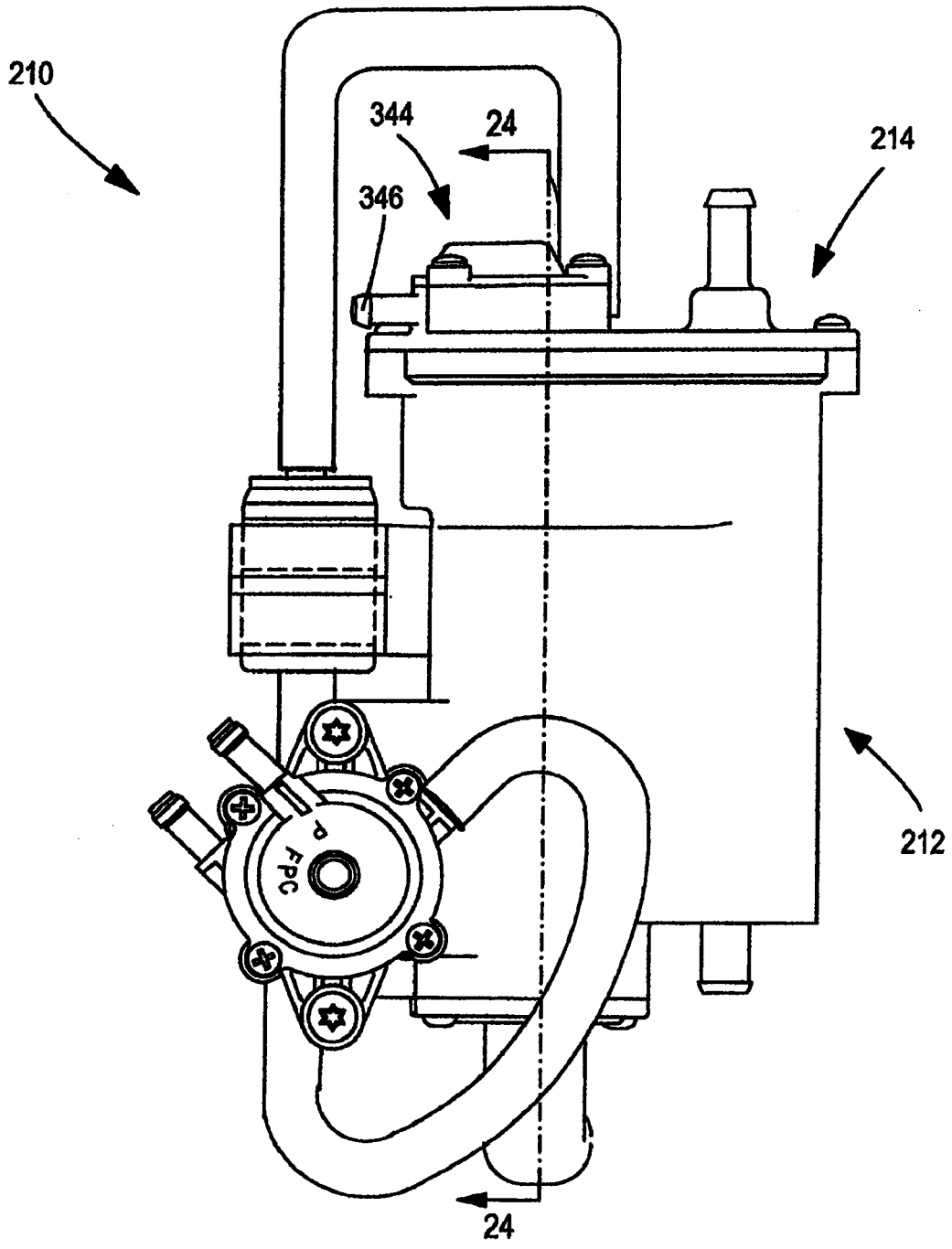
FIG. 23 is a rear elevational view of the vapor separator of FIG. 17.

Referring to FIGS. 20 and 22, from the valve 242, incoming fuel flows into the vapor separator interior, which may include a fuel reservoir 252 and a pump chamber 254, which may be at least partially defined by a fuel pump cover 256 of the container assembly 212. The closure 224 may also at least partially define a vapor chamber 253 above the level of fuel L in the fuel reservoir 252. In other words, the vapor chamber 253 may be defined anywhere between the level of fuel L in the reservoir 252 and any portion(s) of the closure 224.

Referring now to FIGS. 18 and 19, the container 258 may have several integral components. For example, a bottom wall 260 of the container 258 may include an integrally extending coolant nozzle 262 such as an outlet coolant nozzle. Also, a fuel rail may be integrated with the rest of the container 258 and may include injector mounting bosses 268. The injector mounting bosses 268 may include injector return passages 270, and injector supply passages 272.

Figure 21:
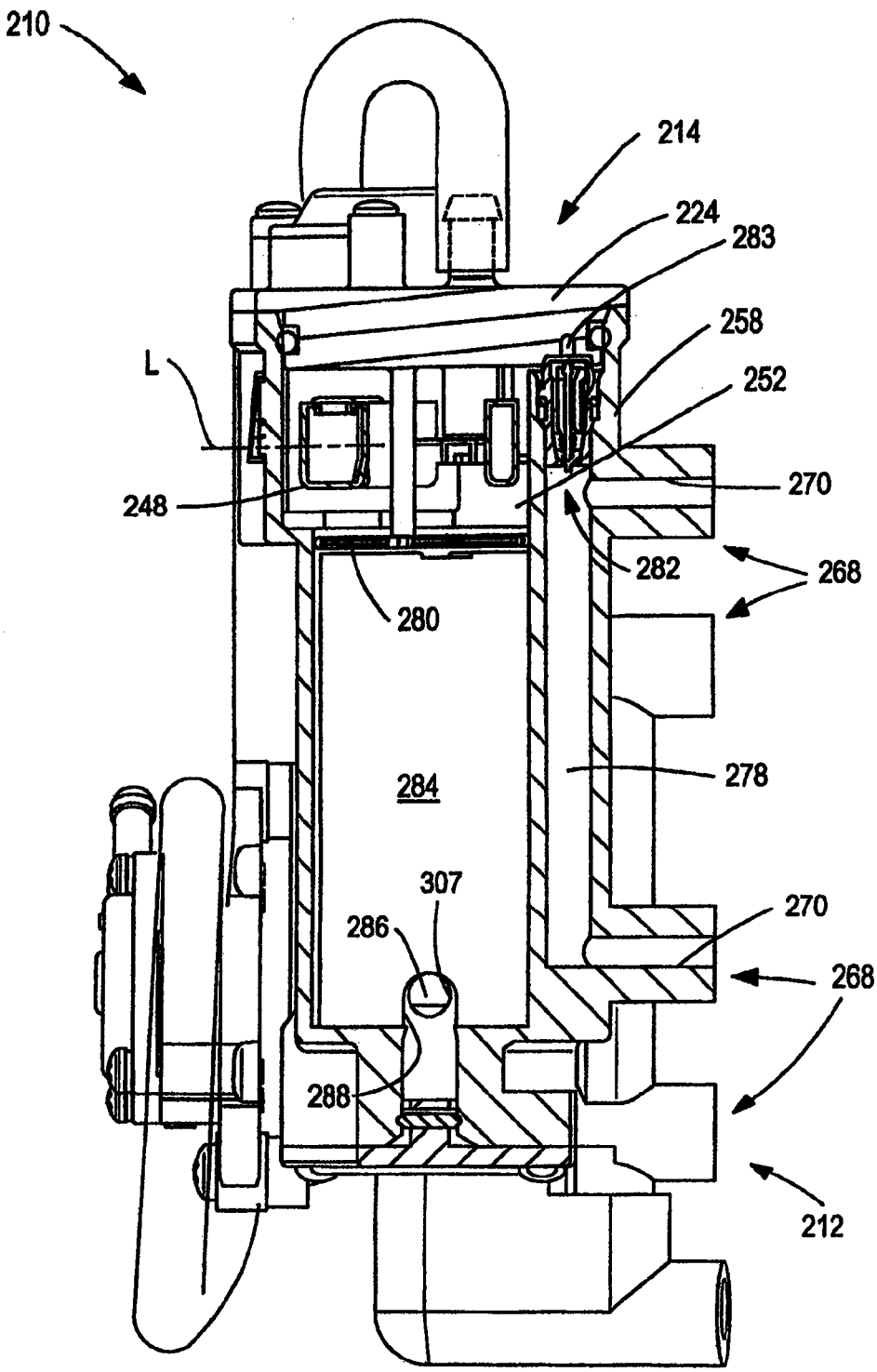
FIG. 21 is a cross-sectional view of the vapor separator shown in FIG. 19, taken along line 21-21 thereof.

Referring now to FIG. 21, the fuel rail may also include a common return conduit 278 in the container 258 in communication with the return passages 270. The container assembly 212 may further include a pressure regulator 282 to permit fuel in excess of that used by the engine to return to the fuel reservoir 252. The closure 224 may include a pocket 283 to receive and guide a portion of the pressure regulator 282. The pressure regulator 282 may be any type of fuel pressure regulator. Excess fuel returned from the injectors flows through the pressure regulator 282, and into the container assembly 212. In particular, fuel vapor may flow into and collect in the fuel reservoir 252 above the level of liquid fuel whereas liquid fuel may flow into and collect in the container assembly 212. The container assembly 212 may further include a generally planar fuel filter 280 carried by the container 258 and extending transversely across at least a portion of the fuel reservoir 252.

Referring to FIGS. 21 and 22, the interior of the container assembly 212 may be separated into the fuel reservoir 252 and the pump chamber 254 by an internal wall 284 of the container 258. The container assembly 212 may also include a fuel pump assembly 286 disposed in and supported by the pump chamber 254. The fuel pump assembly 286 may include a motorized fuel pump 306, a sleeve 309 into which the fuel pump assembly 286 is inserted, a lower seal 311 between the sleeve 309 and walls 259, 284 of the container 258, an upper seal 313 between the pump assembly 286 and inside of the sleeve 309, and a retainer ring 315 inserted in an open upper end of the sleeve 309 and in contact with the container walls 259, 284 to support the assembly 286 and motor wires 220. The fuel pump assembly 286 also includes a check valve 317 carried by a check valve conduit 319 in a lower end of the sleeve 309 to prevent fuel from flowing back into the fuel pump 306. The lower end of the sleeve 309 may be carried by the fuel pump cover 256.

A gap may be defined between a bottom wall 260 of the container 258 and a portion of the internal wall 284 to define a fluid passage 288 between the fuel reservoir 252 and the pump chamber 254. The fuel from the fuel tank and/or the injectors collects in the fuel reservoir 252 and is drawn therefrom by the fuel pump assembly 286, through the fluid passage 288 and an aperture 307 of the sleeve 309.

The fuel pump 306 may be any type of fuel pump, such as a vane pump, impeller pump, gerotor pump, or the like. The fuel pump 306 may be a lower end discharge type of pump such as that disclosed in U.S. Patent Application Publication 2006/0083631 and/or U.S. Pat. No. 6,231,318, which are assigned to the assignee hereof and are incorporated herein by reference in their entireties.

For example, the pump 306 may include a side inlet 314, which may be in fluid communication with the fuel reservoir 252 via the aperture 307 and passage 288 and may be covered with a filter (not shown). The pump 306 may also include a bottom outlet 294 in fluid communication with the check valve 317. Fuel may be pressurized by the fuel pump 306 and conveyed out the fuel outlet 294, past the check valve 317 and into the cover 256.

Figure 24:
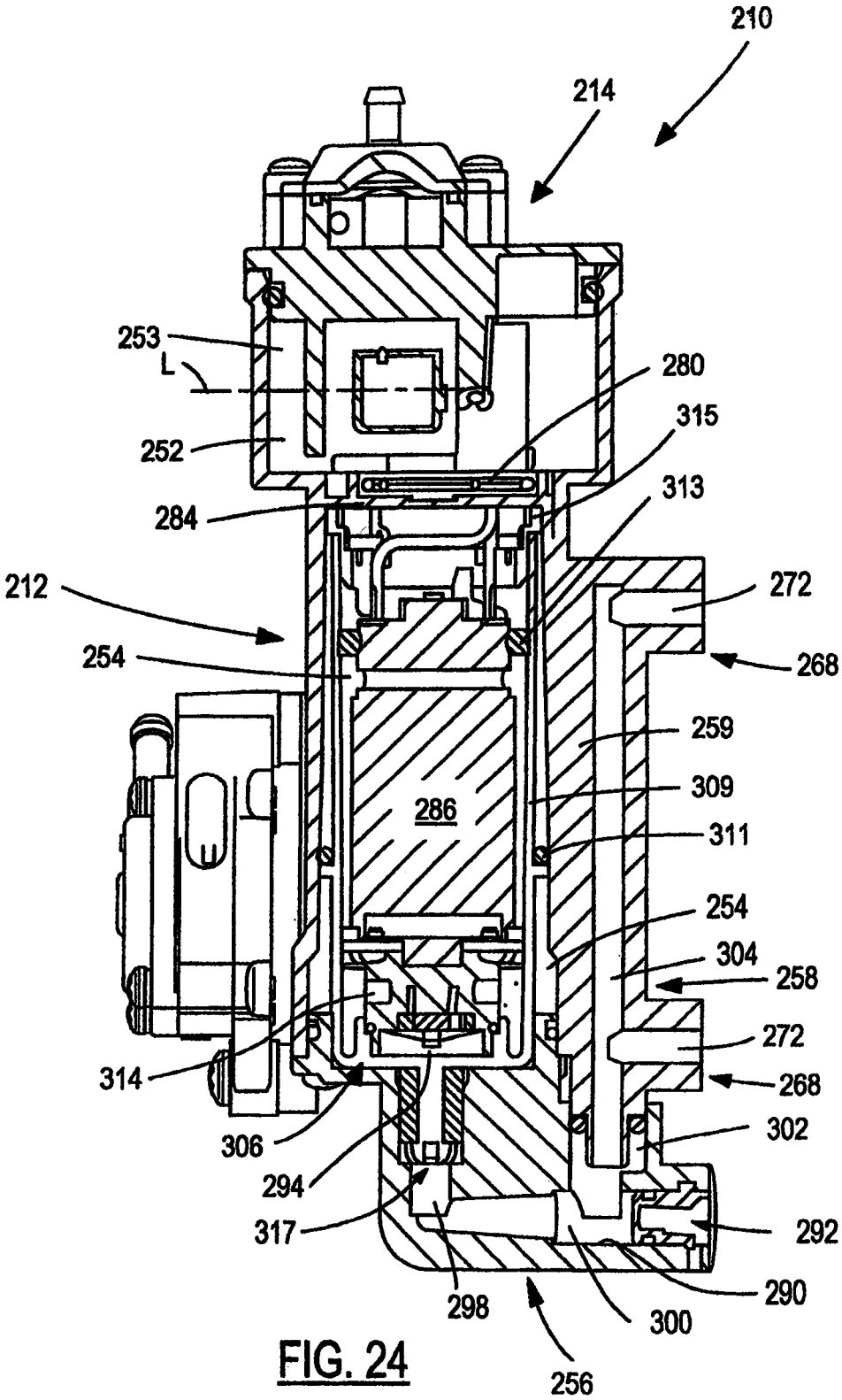
FIG. 24 is a cross-sectional view of the vapor separator shown in FIG. 23, taken along line 24-24 thereof.

Referring to FIG. 24, pressurized fuel flows into and through the pump cover 256. The pressurized fuel flows into a bore 298 of the pump cover 256, and through a conduit, which may include a transverse branch 300 in communication with the bore 298, and an outlet fitting and passage 302 in communication with the transverse branch 300. A manufacturing boss and passage 290 may be formed in the cover 256 to facilitate molding of the conduit 300, 302, and may be sealed with a plug 292. The outlet fitting and passage 302 may be coupled to the container 258 in fluid communication with an injector supply conduit 304 of the integrally formed fuel rail of the container assembly 212. Accordingly, pressurized fuel flows through the supply conduit 304 and out of the vapor separator 210 to the fuel injectors through the injector supply passages 272. The injector supply passages 272 may sealingly engage corresponding portions (not shown) of the injector housings.

Figure 25:
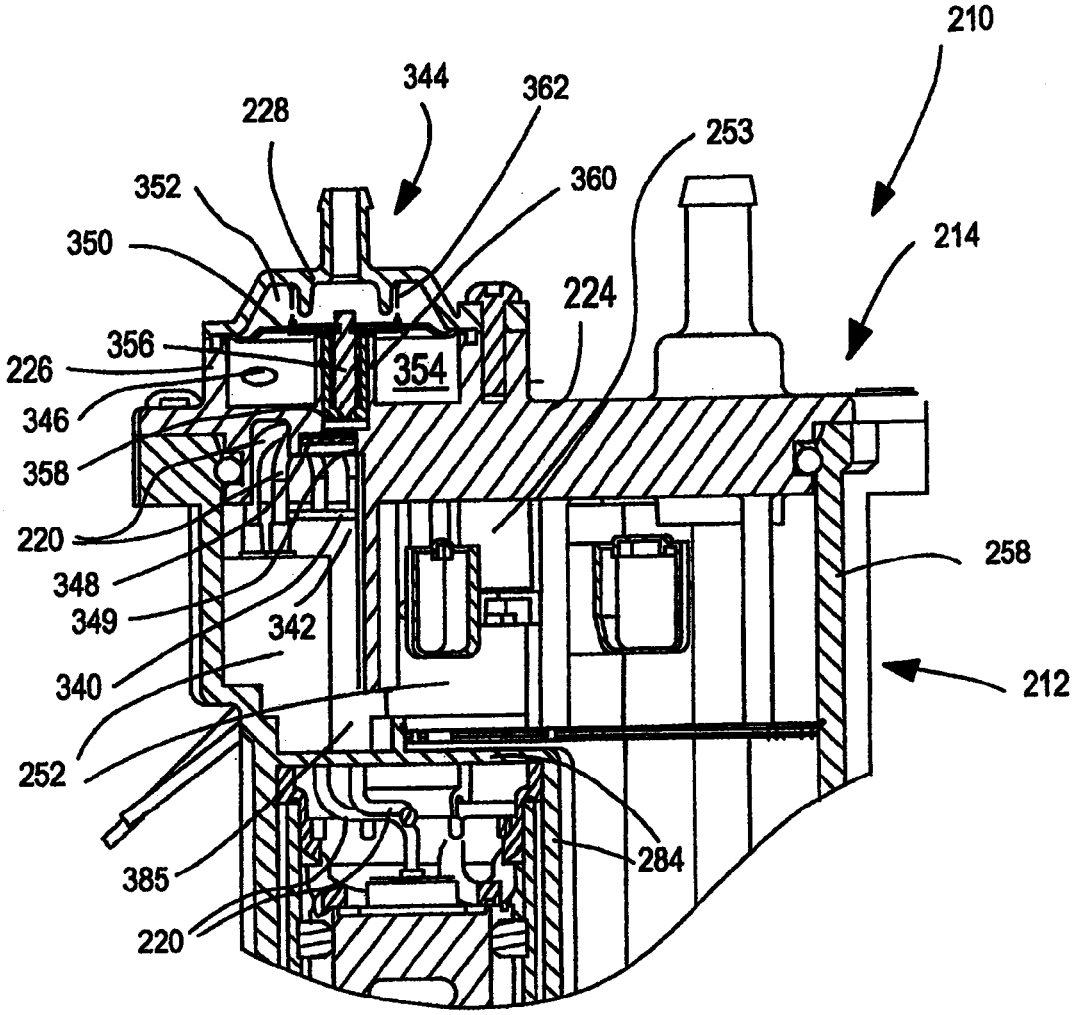
FIG. 25 is a cross-sectional view of the vapor separator shown in FIG. 19, taken along line 25-25 thereof.

Referring to FIG. 25, the motor wires 220 may extend upwardly through a pump tower 285 in fluid communication with the pump chamber 254 and out of the pump tower 285 through a grommet 340 carried in an open upper end 343 of the pump tower 285. The pump tower 285 may be similar to the fuel pump cover 56 of FIG. 5, except that it may be an integral portion of the container 258. The grommet 340 is above the level of fuel in the fuel reservoir 252 and may include one or more passages (not shown) therethrough to vent fuel vapor from the pump chamber 254 into an upper portion of the fuel reservoir 252 such as the vapor chamber 253. The wires 220 may then extend out of the container 258 through one or more other grommets 341 (best shown in FIG. 22).

Referring to FIGS. 24 and 25, the fuel pump assembly 286 may generate some fuel vapor, which may be vented into the vapor chamber 253 from the pump chamber 254. For example, fuel vapor may flow from the pump chamber 254 into the pump tower 284 through an opening (not shown) in the internal wall 284 of the container 258.

Referring to FIG. 25, the fuel vapor in the interior of the vapor separator 210 may be vented externally of the vapor separator 210. Fuel vapor may be contained within the vapor separator 210 above the level of fuel, such as in the vapor chamber 253 between the level of fuel and the cover 224. The vent valve 344 is normally closed to prevent flow of fuel vapors out of the vapor separator 210. When the engine is operating, the vent valve 344 opens under the influence of crankcase vacuum pulses and may be a diaphragm-type vapor vent valve carried by the cover 224. The vapor chamber 253 communicates with the vent valve 344 through a splash screen 348 carried by a pocket 349 in the cover 224. The vent valve 344 may include a diaphragm 350, which may be disposed between the pulse cover and fitting 228 and the vapor vent housing 226 to define a vacuum chamber 352 and a vent chamber 354. The diaphragm 350 may carry a valve 356, which may open and close an aperture in a valve seat 358 carried in a valve boss 360 of the cover 224. The aperture is in fluid communication with the vent chamber 354, such as through axially extending grooves (not shown) in the valve 356 and/or valve seat 358. In turn, the vent chamber 354 is in fluid communication with the vapor vent outlet 346.

The vacuum chamber 352 of the vapor vent 344 may contain a spring 362 for biasing the diaphragm 350 and valve 356 toward a closed position. The vacuum chamber 352 may be coupled to an engine crankcase (not shown), wherein vacuum pulses retract the diaphragm 350 against the bias force of the spring 362 so that the valve 356 retracts to allow fuel vapor to vent through the filter 348, between the valve 356 and the seat 358, and between the top of the seat 358 and the diaphragm 350 and into the vent chamber 354. The fuel vapor may then flow from the vent chamber 354 to and through the outlet 346, whereafter the fuel vapor may vent anywhere, such as the atmosphere, to an intake manifold of the engine, to the fuel tank, to a carbon canister, or any other suitable location(s).

In addition, the vent valve 344 may act as a pressure relief valve. The force of the spring 362 may be selected such that the diaphragm 350 and/or valve 356 prevent fluid from flowing through the vent chamber 354 until a predetermined threshold pressure is reached or exceeded within the vapor separator 210. In other words, the vent valve 344 may limit the maximum pressure in the vapor separator 210 to prevent damage to the vapor separator 210 and associated components.

Figure 26:
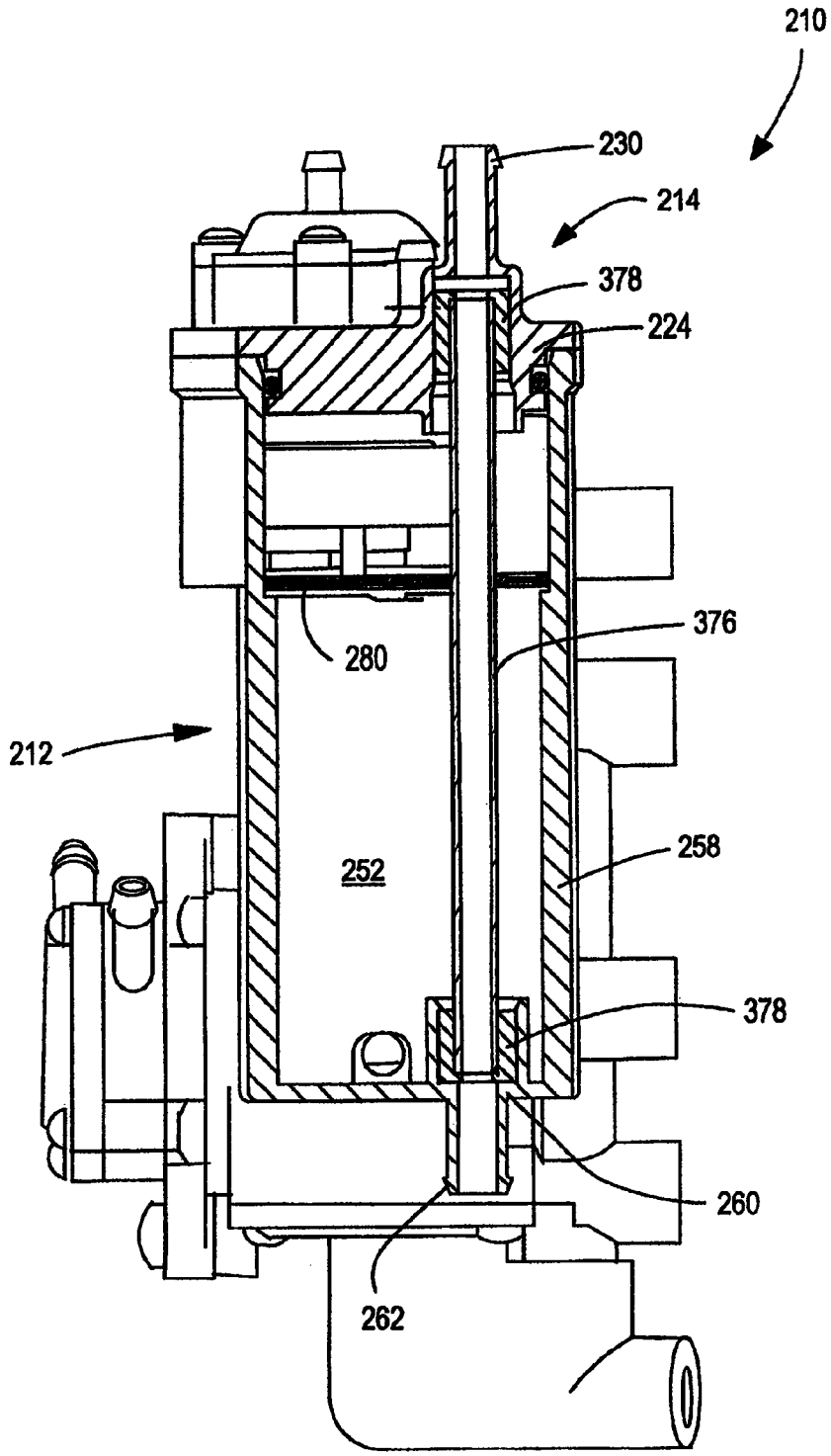
FIG. 26 is a cross-sectional view of the vapor separator shown in FIG. 19, taken along line 26-26 thereof.

As best shown in FIG. 26, the vapor separator 210 may include a heat exchanger tube 376, which may extend through the fuel reservoir 252 and through which coolant may flow. The heat exchanger tube 376 may include a non-coiled tube, such as a straight tube as shown. Nonetheless, the tube 376 may also or instead include a bent, but non-coiled, tube. In any case, the tube 376 may be carried between the cover 224 and the bottom 260 of the container 258 and may extend through a corresponding aperture in the fuel filter 280. More specifically, the end of the tube 376 may be carried in a pocket of the cover 224 with a seal 378 therebetween and in fluid communication with the coolant inlet 230. Also, the other end of the tube 376 may be carried in a pocket in the bottom 260 of the container 258 with a seal 378 therebetween and in fluid communication with the coolant outlet 262.

The vapor separators 10, 210 may be assembled according to known techniques, and the various components of the vapor separators 10, 210 may be manufactured according to techniques known to those skilled in the art, including molding, machining, stamping, and the like. Likewise, any suitable materials can be used in making the components, such as metals, composites, polymeric materials, and the like. Such materials may be selected based on their dimensional stability and resistance to swelling and degradation in warm and cold petroleum product environments. The phrase polymeric material(s) generally means relatively high-molecular-weight materials of either synthetic or natural origin and may include thermosets, thermoplastics, and elastomers. For use in fuel systems, the polymeric material should exhibit suitable resistance to petroleum products.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

What is claimed is:

1. A fuel vapor separator for an engine with a crankcase, comprising:

an electric fuel pump;

a container at least partially defining a fuel reservoir to hold fuel and a pump chamber to hold the fuel pump;

a closure carried by the container to close the fuel reservoir and at least partially defining a vapor chamber above a level of fuel in the fuel reservoir and in fluid communication with the pump chamber; and a vapor vent valve carried by the closure and having a diaphragm communicating with the crankcase of the engine to open continuously the vent valve to allow fuel vapor to vent from the vapor chamber during engine operation and is otherwise closed to prevent liquid fuel from flowing therethrough out of the vapor separator.

2. The vapor separator of claim 1, wherein the closure includes a valve boss and a vapor vent housing, and wherein the vent valve includes:

a vent cover carried by the vapor vent housing and configured for fluid communication with an engine crankcase, the diaphragm is carried between the vapor vent housing and the vent cover, a spring disposed between the vent cover and the diaphragm to urge the diaphragm toward the valve boss, and a valve body disposed in the valve boss in fluid communication with the vapor chamber and carried by the diaphragm.

3. The vapor separator of claim 2, further comprising a splash screen, wherein the closure includes a pocket in fluid communication between the vapor chamber and the vent valve, wherein the splash screen is carried in the pocket.

4. The vapor separator of claim 1, further comprising an external fuel pump carried by the container to pressurize fuel for delivery into the vapor separator.

5. The vapor separator of claim 4, wherein the external fuel pump is a diaphragm fuel pump operated by pressure pulses from the engine crankcase.

6. The vapor separator of claim 1, further comprising a fuel filter carried by the container.

7. The vapor separator of claim 1, further comprising a pressure relief valve carried by the closure.

8. The vapor separator of claim 7, wherein the pressure relief valve includes a valve seat carried by the closure and a spring biased valve carried in the valve seat.

9. The vapor separator of claim 1, further comprising injector return passages and a common injector return conduit in fluid communication with the return passages and the fuel reservoir, and further including injector supply passages and a common injector supply conduit in fluid communication with the supply passages and the outlet of the fuel pump.

10. The vapor separator of claim 9, wherein the container includes injector mounting bosses carrying the return and supply passages.

11. The vapor separator of claim 10, wherein the injector mounting bosses also carry mounting passages therethrough.

12. The vapor separator of claim 9, further comprising a fuel pressure regulator carried in the injector return conduit.

13. The vapor separator of claim 12, further comprising a closure carried by the container to close the container and at least partially defining a vapor chamber above the level of fuel, wherein the closure includes a pocket to receive a portion of the fuel pressure regulator, and wherein the fuel pressure regulator is located downstream of the injector return passages and between the container and the closure.

14. The vapor separator of claim 12, further comprising a fuel filter carried in the injector conduit upstream of the fuel pressure regulator.

15. The vapor separator of claim 9, further comprising a fuel filter carried in the injector return conduit.

16. The vapor separator of claim 9, further comprising seals carried in the injector return and supply passages.

17. The vapor separator of claim 1, further comprising a fuel pressure regulator carried by the container.

18. The vapor separator of claim 17, wherein the fuel pressure regulator includes a valve and the closure includes a pocket configured to accept and guide a portion of the valve.

19. The vapor separator of claim 17, further comprising a fuel filter carried by the container and disposed upstream of the fuel pressure regulator.

20. The vapor separator of claim 17, further comprising a fuel filter extending transversely across at least a portion of the fuel reservoir.

21. The vapor separator of claim 1, further comprising a non-coiled heat exchanger tube extending through the fuel reservoir.

22. The vapor separator of claim 21, wherein the tube is carried by the container and the closure.

23. The vapor separator of claim 22, wherein ends of the tube are disposed in pockets of the container and the closure.

24. The vapor separator of claim 22, further comprising seals disposed between ends of the tube and the container and closure.

25. A vapor separator, comprising:

a fuel pump;

at least one electric wire connected to the fuel pump;

a container assembly including a container at least partially defining a pump chamber in which the fuel pump is disposed and a fuel reservoir to hold liquid fuel;

a closure carried by the container to close the fuel reservoir and at least partially defining a vapor chamber above the level of liquid fuel; and a wire grommet carried by the container assembly above the level of liquid fuel, receiving the electric wire therethrough, and including at least one vapor passage therethrough to convey fuel vapor from the pump chamber to the vapor chamber.

26. The vapor separator of claim 25, wherein the container assembly includes a pump cover carried by the container and partially defining the pump chamber, wherein the wire grommet is carried in an open upper end of the pump cover.

27. The vapor separator of claim 25, wherein the container includes a pump tower in fluid communication with the pump chamber and including an open upper end carrying the wire grommet therein.

28. The vapor separator of claim 25, for an engine with a crankcase and further comprising a vapor vent valve carried by the closure and having a diaphragm communicating with the crankcase of the engine to open the vent valve to allow fuel vapor to vent from the vapor chamber during engine operation and is otherwise closed to prevent liquid fuel and fuel vapor from flowing therethrough.

29. A vapor separator, comprising:

a fuel pump including an inlet end, and an inlet fuel port and a vapor purge port at the inlet end;

a container at least partially defining a pump chamber in which the fuel pump is disposed and a fuel reservoir to hold fuel; and a seal carried by the inlet end of the fuel pump and including:

an outer surface to engage a portion of the container, a recess to engage the inlet end of the fuel pump, a divider including a projection in contact with the inlet end of the fuel pump to sealingly separate the inlet fuel port from the vapor purge port, an inlet aperture in fluid communication with the inlet port, a vapor purge pocket in fluid communication with the vapor purge port, and a vapor purge aperture in fluid communication between the vapor purge pocket and the pump chamber.

30. The vapor separator of claim 29, further comprising a fuel filter carried by the seal.

31. The vapor separator of claim 30, wherein the seal further includes a second recess in which the fuel filter is carried.

32. The vapor separator of claim 29, wherein the container includes an internal wall and a bottom, wherein a fluid passage is defined between a portion of the internal wall and the bottom in fluid communication between the fuel reservoir and the pump chamber.

33. The vapor separator of claim 32, wherein the inlet aperture of the seal is in fluid communication with the fluid passage to receive fuel from the fuel reservoir.

34. The vapor separator of claim 32, further comprising a pump cover carried by the container atop the internal wall and including a fuel outlet conduit therethrough, wherein the fuel pump includes an outlet in fluid communication with the fuel outlet conduit of the pump cover.

35. The vapor separator of claim 29, for an engine with a crankcase and further comprising a closure carried by the container to close the fuel reservoir and at least partially defining a vapor chamber above a level of liquid fuel in the fuel reservoir and in fluid communication with the pump chamber; and a vapor vent valve carried by the closure and having a diaphragm communicating with the crankcase of the engine to open the vent valve to allow fuel vapor to vent from the vapor chamber during engine operation and is otherwise closed to prevent liquid fuel and fuel vapor from flowing therethrough.

* * * * *